US005652992A

United States Patent [19]

Ng

[11] Patent Number: 5,652,992

[45] Date of Patent: Aug. 5, 1997

[54] ROTARY SAND AND DEBRIS CLEANER

[76] Inventor: Kim Kwee Ng, P.O. Box 379, Selden Post Office, Selden, N.Y. 11784-0379

[21] Appl. No.: 406,454

[22] Filed: Mar. 20, 1995

[51] Int. Cl.[6] ..... E01H 1/04

[52] U.S. Cl. ..... 15/79.2; 15/80; 15/81; 15/84

[58] Field of Search ..... 15/78, 79.1, 79.2, 15/80, 81, 82, 83, 84, 85, 86, 87

[56] References Cited

U.S. PATENT DOCUMENTS

| | | | |
|---|---|---|---|
| 501,515 | 7/1893 | Johnson | 15/84 |
| 684,618 | 10/1901 | Schmidt | 15/80 |
| 981,652 | 1/1911 | D'Homergue | 15/84 |
| 1,047,403 | 12/1912 | Goldstein | 15/84 |
| 1,224,771 | 5/1917 | Miller | 15/84 |

FOREIGN PATENT DOCUMENTS

| | | | |
|---|---|---|---|
| 92-10614 | 6/1992 | WIPO | 15/87 |

*Primary Examiner*—Mark Spisich

[57] ABSTRACT

A device for removing sand, solid particulate wastes and the like from a surface being cleaned, comprising spade-shaped members driven in a closed rotatory circuit cooperating with a brush in synchronized sweeping motion. In a first embodiment, a rotatory belt mounting a plurality of circumferentially spaced apart spade-shaped collector elements cooperates to receive material swept by a single brush in pendulum arcuate motion and then elevates the waste for deposit into a storage container for later disposal. In a second embodiment, the sweeping action is provided by the reciprocating motion of a first rotational belt mounting a plurality of transverse, circumferentlally spaced-apart rows of brushes and the receiving and elevating is done by a second belt mounting an array of circumferentially spaced-apart spade-shaped collector elements. The first belt and the second belt are driven in counter rotational senses in predefined circuits while the first belt is translocated in synchronized reciprocating motion towards and away from the second belt. A stored program device means is provided for synchronizing and controlling both the spade-shaped collector elements and the brushes for removing sand and debris off roadways and the like.

10 Claims, 4 Drawing Sheets

ROTARY SAND AND DEBRIS CLEANER

FIELD OF THE INVENTION

A collecting device used to clear sand and debris off roadways and the like.

DESCRIPTION OF THE PRIOR ART

U.S. Pat. No. 5,329,661, "Debris/Litter Collection Apparatus Having A Conveyor Which Intermeshes With Fingers Of Collector Roller", describes the use of fingers mounted on two essentially parallel counter-rotating conveyor belts in cooperation with fingers mounted on ground-contacting rollers. Debris is lifted by the intermeshing pairs of fingers and transported upwardly to a locus for removal and deposit into a collecting device for final disposal. The use of intermeshing fingers restricts the described device to clearing debris other than sand or particulate matter. Since the fingers are mounted radially on the outer surfaces of the rotating rollers, the intermeshing fingers for picking up debris often have limited surface contact with the ground surface being cleaned.

U.S. Pat. No. 4,550,465, "Apparatus For Collecting Litter And Objects From a Ground Surface" uses a conveyor belt mounting rows of fingers molded onto and uniformly spaced apart along the length of a belt to convey litter from a litter-collecting assembly to a trash collection drum. Each finger includes a free end angled in the direction of conveyor movement to assure positive retention of litter. The fingers on the conveyor belt are used to transport the debris after the debris is picked up by the rotating action of fingers mounted on rollers comprising the litter-collecting assembly. Gaps between adjacent fingers limit the size of the debris being collected to objects of a size large enough to bridge such gaps. The intermeshing action of the fingers on the rollers and the fingers on the conveyor belt may, in some instances, shred papers, plastic bags and the like to produce pieces of a size that can fall through the gaps between the fingers on the conveyor belt.

Thus, neither of these devices of the prior art which employ fingers are of any use for removing sand and the like particulate litter. What is needed is an apparatus that it capable of removing sand as well as other litter and debris from roadways and ground surfaces.

What is needed is a cleaning device that provides for continuous removal of sand and debris by simple means that can readily be made and assembled at low cost. It is an object of this invention to provide an improved and a more efficient collector which substantially satisfies these desired criteria. Rotating belts as employed in my invention offer greater flexibility than cylinder elements for continuously removing sand and debris. My invention is flexible in design, permitting relocation of various elements in different configurations in embodiments where indicated by user consideration. The use of belt-mounted flexible brushes and the like provide for a light weight structure that can be adapted easily to suit different needs.

The deficiencies in collecting debris using the devices of the prior art mentioned above are effectively eliminated by the use of an array of spade-shaped collector elements co-operating with brushes for direct removal of sand and other litter from the ground. The spade-shaped collector elements are able to hold a broad range of debris, such as sand, soft and deformable materials, slippery items, bottles and the like. A rotating deformable belt mounting an array of spade-shaped collector elements in co-operation with the sweeping action of a brush provides continuous debris collection. Since a deformable belt can describe a non-circular orbit, the circuit of such a belt can be configured to have a portion of its circuit substantially parallel to the ground, so that the spade-shaped collector elements and the rows of brushes mounted on the rotating belts have an extended surface contact with the ground. Such extended surface contact will significantly improve the efficiency of sand and debris collection.

SUMMARY OF THE INVENTION

These and other deficiencies of the prior arts are eliminated by my invention which uses brushes or the like to sweep debris onto the spade-shaped collector elements mounted on a conveyor belt for elevation to and deposit into a storage hopper or the like. A belt having a plurality of spade-shaped collector elements cooperates with a brush sweeping in a continuous and synchronized pre-defined path to remove sand and debris from a surface being cleaned and to deposit it in a storage container for later disposal. In another embodiment of the invention, the sweeping action is provided by rows of brushes mounted on a first rotational belt and the receiving and elevating operation is carried out by a second rotational belt mounting an array of circumferentially spaced-apart spade-shaped collector elements. The first belt and the second belt are driven in counter rotational senses in pre-defined circuits while the first belt is translocated in synchronized reciprocating motion towards and away from the second belt. A stored program device means can be used for controlling and activating the sweeping motion onto the spade-shaped collector elements in both embodiments. Sand and debris so collected is transported by the spade-shaped collector elements for free-fall into a storage container for later disposal.

DESCRIPTION OF THE PREFERRED EMBODIMENTS

A better and more complete understanding of the practice of my invention is provided by the following description and reference to the accompanying drawings, wherein like symbols refer to like elements of the invention.

Figure 1:
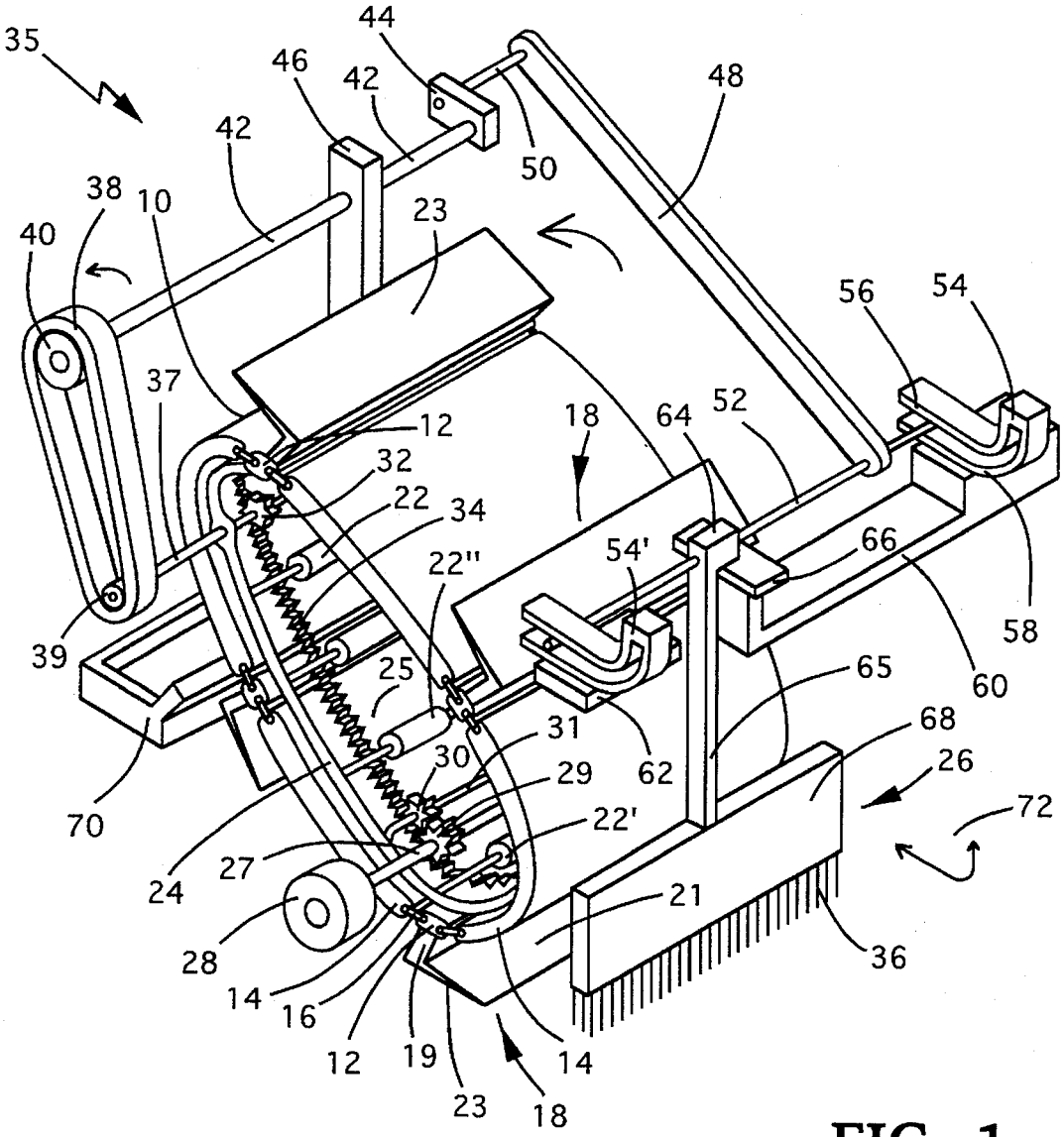
FIG. 1 is a simplified diagram of a preferred embodiment of the invention employing a conveyor belt cooperating with a sweeping brush.

In a first preferred embodiment of my invention, shown in FIG. 1, continuous deformable conveyor belt 10, having planar belt elements 12 of a rigid material linked for articulation with adjacent deformable sections 14 of synthetic material or the like by linkage members 16. Each planar belt element 12 supports a spade-shaped collector element 18, constituting a collector means. Belt 10 is constrained to move in a closed vertical circuit defined by an array of transverse extending rollers 22 supported by bracket 24 fixedly attached to a frame means, not shown, in a counter-clockwise sense as shown in the drawing by the counter-clockwise directional arrow. Each spade-shaped collector element 18 is releasably joined to its planar belt element 12 as by threaded fasteners secured to threaded studs, not shown, wherein a plurality of studs, extending from a first end of upper arm 19 of spade-shaped collector element 18 penetrate corresponding spaced-apart through openings in planar belt element 12. At a second end of upper arm 19, is an orthogonally disposed spade-shaped blade having a collector surface 21 and a sole plate surface 23 with said blade oriented in the direction of the rotation of belt 10. As the debris cleaner device of FIG. 1 is moved in the direction away from belt 10 toward a sweeper element 26, a wheel 28 of a set of wheels mounted on an axle 27, rotates in contact with the surface being swept, rotating a first cog-wheel 29 mounted on axle 27 to rotationally drive a second cog-wheel 30 supported by shaft 31 journaled in bracket 24. Second cog-wheel 30 drives gear track 34 mounted on the inner surface 25 of belt 10, causing belt 10 to rotate in a counter-clockwise direction as shown by the counter-clockwise directional arrow. It should be understood that the upper portion of bracket 24 and the rollers 22 supporting the upper portion of belt 10 are hidden from view by the upper portion of belt 10 in this figure of the debris collector.

Transmission 35 syncronizes the sweeping action of sweeper element 26 with the movement of each spade-shaped collector element 18, so that debris swept along a surface by brush 36 at the lower end of sweeper element 26 is deposited onto collector surface 21 of spade-shaped collector element 18. Transmission 35 receives power from belt 10, via shaft 42 driven by drive wheel 40 which in turn is driven from shaft 37 by belt 38 via drive wheel 39. Shaft 37, journaled in bracket 24, is rotated by cog-wheel 32 in rotational engagement with gear track 34 mounted on the inner surface 25 of belt 10. Shaft 42 is journaled in upright support member 46, attached to the said frame means.

Rotary motion of shaft 42 is converted to translational reciprocating motion by a crank shaft 48 at the end of shaft 42 distant from belt 38 having a crank arm 44 and a shaft pin 50, journaled for rotation in crank shaft 48. Crank arm 44, driven by shaft 42, causes the upper end of the crank shaft 48 to rotate while the lower end of the crank shaft 48 translocates in a reciprocal fashion along a path defined by the movement of shaft 52, attached orthogonally to crank shaft 48 at its lower end in the path defined by guides 54 and 54'. Guides 54 and 54' each have an upper finger 56 and a spaced-apart lower finger 58 and shaped to provide a path there between for the movement of shaft 52 such that shaft 52 in a first half of a translational reciprocal cycle has a substantially long horizontal run terminating in a short vertical run and in a second half of a said cycle has a short vertical run followed by a long horizontal run. Guides 54 and 54' are each supported by a support means 60 and a support means 62 from said frame.

Sweeper element 26 includes an upright member 65 driven by the translational motion of shaft 52, journaled through shoulder element 64 at the upper end of upright member 65. Shoulder element 64 is adapted to translational reciprocal movement along an upper horizontal surface of platform 66 supported by support means 60 from said frame means. Sweeper element 26 includes at the lower end of upright member 65 a movable barrier 68 bearing a depending brush 36. Thus, sweeper element 26 is constrained to move in a path that results in a sweeping motion along the surface being cleaned, with debris movement reciprocating away from and towards a spade-shaped collector element 18 with an elevation of brush 36 from the surface being cleaned at the termination of movement away from a spade-shaped collector element 18 in the path as shown by the double-headed curved arrow 72. Movement of sweeper element 26 is synchronized with the movement of each spade-shaped collector elements 18 by transmission 35, whereby brush 36 sweeps sand and debris onto a spade-shaped collector element 18 when the spade-shaped collector element 18 is in position for picking up sand and debris. Sand and debris collected by a spade-shaped collector element 18 is then transported to an elevated portion of the circuit of belt 10 for free fall into storage container 70. It will be understood that to ensure proper synchronization of the various elements of the apparatus, the circumference of the drive wheel 40 must be equal to the circumferential distance between any two of the successive planar belt elements 12, provided that the distance transversed by one revolution of cog-wheel 32 is equal to the circumference of the drive wheel 39.

Belt 10 is constrained to move in a pre-defined rotational circuit such that at a lowest portion of the circuit between rollers 22' and roller 22", belt 10 is substantially parallel to the surface being cleaned, thus providing an extended region for horizontal movement of a spade-shaped collector element 18 with its sole plate 23 parallel to a surface being cleaned, thereby assuring sliding contact and avoiding digging contact between spade-shaped collector element 18 and the surface, as a spade-shaped collector element 18 translocates downwards during rotational motion of belt 10.

The design criteria for the embodiment of FIG. 1 are such that during the time interval wherein the debris cleaner device advances half the distance from a first debris collection locus to a second debris collection locus, in a first time interval, each spade-shaped collector element 18 translocates one-half of the distance separating two successive planar belt elements 12 along the circuit of belt 10, and the debris cleaner device simultaneously advances one unit length of distance and extends sweeper element 26 forward to the extreme outer terminus of its sweeping cycle, a distance equal to two unit lengths of distance from the inner terminus of its sweeping cycle. This means that sweeper element 26 is positioned a total of three unit lengths of distance from the first locus of debris collection at the end of the first time interval and the sweeper element 26 is raised to an altitude above the pile of debris swept by the sweeper element 26 on the ground surface to be cleaned. During a second time interval equal to the first time interval and immediately following the first time interval, the debris cleaner device advances a second unit length of distance, for a total distance of two units lengths of distance from the first locus of debris collection to a second locus of debris collection and a spade-shaped collector element 18 is in position ready for receiving sand and debris swept by sweeper element 26 during the second time interval. During the second time interval, sweeper element 26, having positioned beyond the pile of debris by the continued forward movement of the debris cleaner device as the sweeper element 26 descends to reach the ground surface, has a relative velocity towards the debris cleaner device of two unit lengths of distance for one time interval while its relative velocity with respect to the surface being cleaned is one unit length of distance for one time interval. Thus, each successive debris collection is spaced apart two unit lengths of distance. The transverse distance between the rotation axis of shaft 42 and that of shaft pin 50 determines the distance made by the sweeper element 26 from the inner terminus to the extreme outer terminus of its sweeping cycle so that the surface to be cleaned of debris is free of lacunae.

Figure 2:
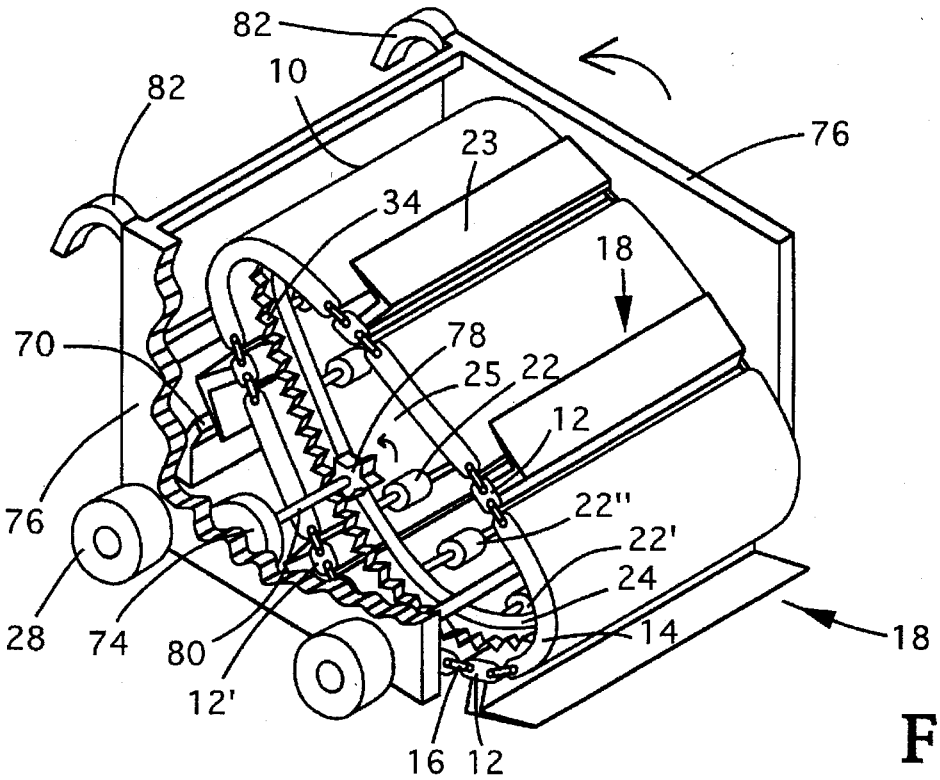
FIG. 2 is a simplified diagram of an embodiment of the invention adapted for use with a single belt having a power drive using a gear track mounted on its inner surface.

Referring now to FIG. 2 which shows a manually pushed embodiment of my invention adapted for use with a power drive means for belt rotation wherein like symbols of FIG. 1 and FIG. 2 refer to like elements. Power drive means 74, mounted on body frame means 76, drives cog-wheel 78 via shaft 80 in rotational engagement with gear track 34 mounted on the inner surface, 25, of belt 10, in a counter-clockwise direction as shown by the counter-clockwise directional arrow, rotating belt 10 in a counter-clockwise direction. The debris collector is mounted on a set of wheels 28 for movement during debris cleaning. A pair of handles 82 is mounted on body frame means 76 for controlling the movement of the debris collector.

Figure 3:
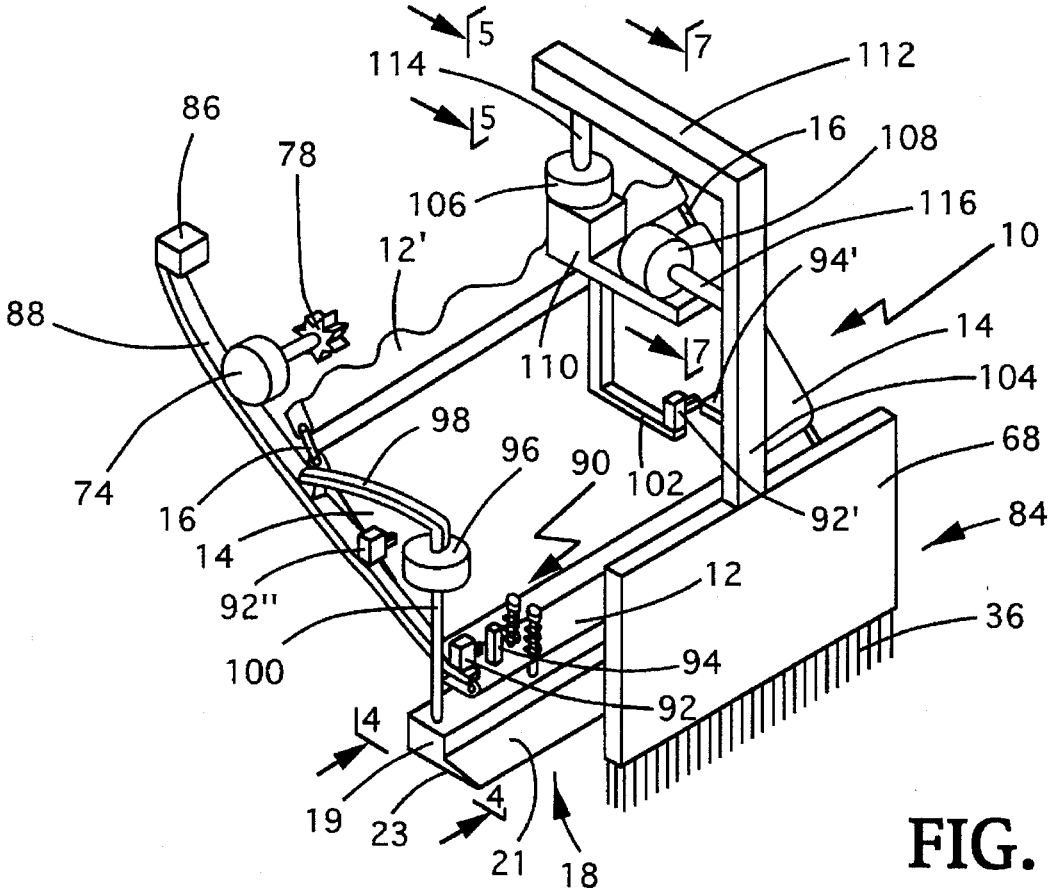
FIG. 3 is a partial view of a simplified diagram of a portion of an embodiment of the invention employing a stored program device means for synchronizing the cooperative movement of the sweeping and collecting.

Referring now to FIG. 3, showing certain elements of another embodiment of my invention for use with a stored program device means wherein like symbols of FIG. 2 and FIG. 3 refer to like elements, a sweeper 84 is used in conjunction with the apparatus of FIG. 2. Stored program device means 86 mounted on a bracket 88 supported from a frame means, not shown, is used for programming the cooperative action of each spade-shaped collector element 18 with the movement of sweeper 84, for controlling electrical devices of the debris collector for debris collection from a horizontal surface. Using a computer program, the stored program device means, 86, executes instructions in response to the presence or the absence of input signals from an array of sensors to produce output signals to control the operation of a debris collector. Upper arm 19 of each spade-shaped collector element 18 is supported by a planar belt element 12 of belt 10 for limited movement normal thereto by an array of spring-biased studs, called extensible supports, 90, having each urging its associated spade-shaped collector element 18 towards the outwardly-facing surface of its supported planar belt element 12. Sensor 92 mounted on a frame-supported bracket 88, provides input signals to stored program device means 86. The proximity of marker pylon 94, mounted on an inwardly-facing surface of each planar belt element 12, is sensed by sensor 92 which includes a bistable device for transmitting a sensing signal of a selected one of two polarities to stored program device means 86 in response to the presence or absence of a marker pylon 94 within the proximity limit of sensor 92. Stored program device means 86, in response to receipt of a sensor signal of a selected polarity to signal the presence of marker pylon 94 in close proximity to sensor 92, transmits a signal to actuate bi-directional solenoid 96, constituting a power drive means mounted on bracket 98 attached to bracket 88 and supported by a frame means, not shown, for forceable extension of thrust shaft 100 against upper arm 19 of spade-shaped collector element 18, thereby driving spade-shaped collector element 18 downwardly until sole plate 23 is in contact with surface being cleaned. A substantially identical bi-directional solenoid, not shown, situated for actuation at the opposite end of the same planar belt element 12, is simultaneously activated thereby assuring movement of spade-shaped collector element 18 in a direction substantially normal to planar belt element 12. Sweeper 84, having a brush 36 at the lower edge of movable barrier 68, is synchronized to brush inwardly towards spade-shaped collector element 18 and sweep debris onto surface 21 of spade-shaped collector element 18 at the inner terminus of its sweeping cycle. When sweeper 84 reaches the inner terminus, sensor 92' mounted on a bracket 102 attached to a frame means, not shown, senses the proximity of a marker pylon 94', mounted on upright member 104 of sweeper 84, and transmits a signal of a selected one of two polarities to stored program device means 86 to signal the proximity of marker pylon 94' at the inner terminus of the sweeping cycle of sweeper 84.

Upon receipt of a signal from sensor 92 indicating proximity of a marker pylon 94 and a signal from sensor 92' indicating that sweeper 84 has reached the inner terminus of its sweeping cycle, stored program device means 86 activates vertical actuator 106 and horizontal actuator 108, constituting power drive means for actuations, both mounted on frame-supported base 110, to elevate and extend sweeper 84, comprising a horizontal arm 112, upright member 104 and a dependent brush 36, outwardly to the outer terminus of its sweeping cycle by extension of thrust rod 114 and thrust rod 116. Sensor 92", mounted in spaced apart relationship with sensor 92 on bracket 88 at a distance equal to one-half the distance between any pair of nearest planar belt elements 12 and 12' along the circuit of belt 10 in the region defined by sensor 92 and sensor 92", signals the proximity of a marker pylon 94, enabling stored program device means 86 to initiate a change of direction of thrust rod 114 and thrust rod 116 and to control the speed of the stroke of thrust rod 116 in each direction during the sweeping cycle of sweeper 84, the time lapse between the generation of signals indicating proximity of a marker pylon 94 by sensor 92 and sensor 92" provides the stored program device means 86 with the information to control the speed of the sweeper 84 during its sweeping cycle. Electrical cables connecting the various electrical components of the debris collector are not shown in FIG. 3.

The design criteria for the embodiment of FIG. 3 are such that during the time interval within the debris cleaner device advances half the distance from a first debris collection locus to a second debris collection locus, in a first time interval, each spade-shaped collector element 18 translocates one-half of the distance separating two successive planar belt elements 12 along the circuit of belt 10, and the debris cleaner device simultaneously advances one unit length of distance and extends sweeper 84 forward to the extreme outer terminus of its sweeping cycle, a distance equal to three unit lengths of distance from the inner terminus of its sweeping cycle. This means that sweeper 84 is positioned a total of four unit lengths of distance from the first locus of debris collection at the end of the first time interval. During a second time interval equal to the first time interval and immediately following the first time interval, the debris cleaner device advances a second unit length of distance, for a total distance of two units lengths of distance from the first locus of debris collection to a second locus of debris collection and a spade-shaped collector element 18 is in position ready for receiving sand and debris swept by sweeper 84 during the second time interval. During the second time interval, sweeper 84 has a relative velocity towards the debris cleaner device of three unit lengths of distance for one time interval while its relative velocity with respect to the surface being cleaned is two unit lengths of distance for one time interval. Thus, each successive debris collection is spaced apart two unit lengths of distance. The stored program device means is programmed to control the movements of the elements responsive to vertical actuator 106 and horizontal actuator 108, whereby the surface being cleaned is swept clean of debris without lacunae.

Figure 4:
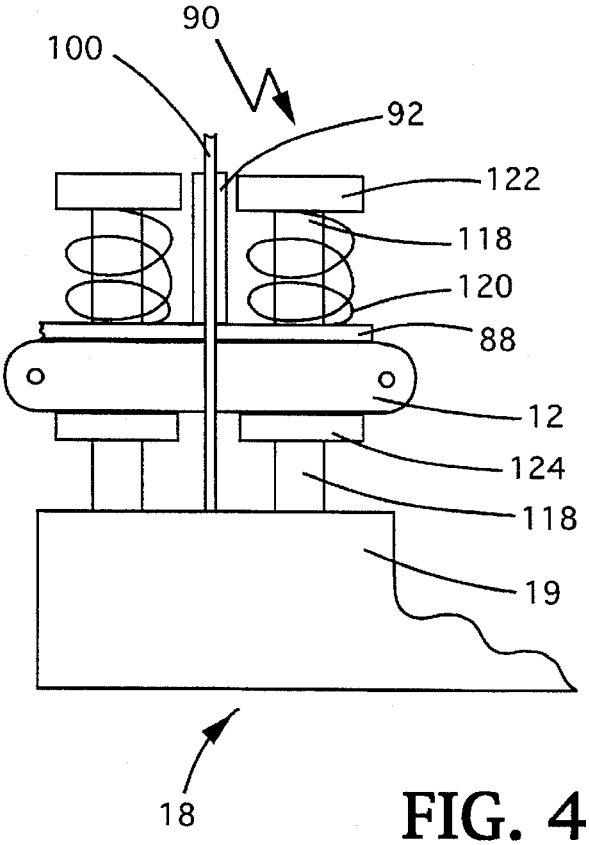
FIG. 4 is an enlarged partial view along the line 4—4 of FIG. 3, illustrating the mounting of a spade-shaped collector element for actuation.

Referring now to FIG. 4, which is a view along view line 4—4 in FIG. 3, an extensible support, identified as 90 in FIG. 3 and FIG. 4 is detailed showing how spade-shaped collector element 18 is attached to a planar belt element 12 by a plurality of extensible supports, each having a flanged threaded stud 118 enclosed by helical spring 120 which is held captive between the upper surface of planar belt element 12 and a cap nut 122 with flange 124 of stud 118 urged against the lower surface of planar belt element 12. Planar belt element 12 has a vertical through bore adapted to the limited passage of stud 118 downwardly therethrough when upper arm 19 of spade-shaped collector element 18 is driven downwardly by the extension of thrust shaft 100. Disengagement of thrust shaft 100 from upper arm 19 permits upward movement of spade-shaped collector element 18 in response to urging of helical spring 120.

Figure 5:
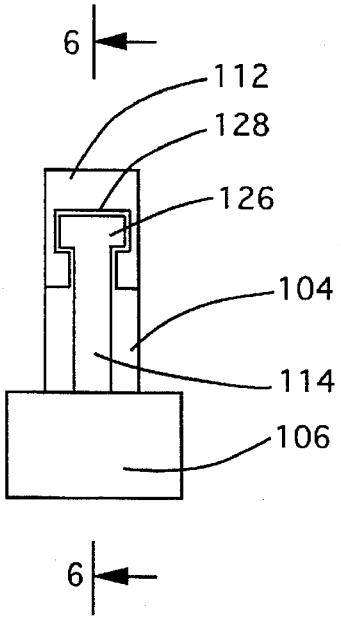
FIG. 5 is a partial view taken along the line 5—5 of FIG. 3, illustrating the structure supporting a thrust rod of an actuator in a guideway.
Figure 6:
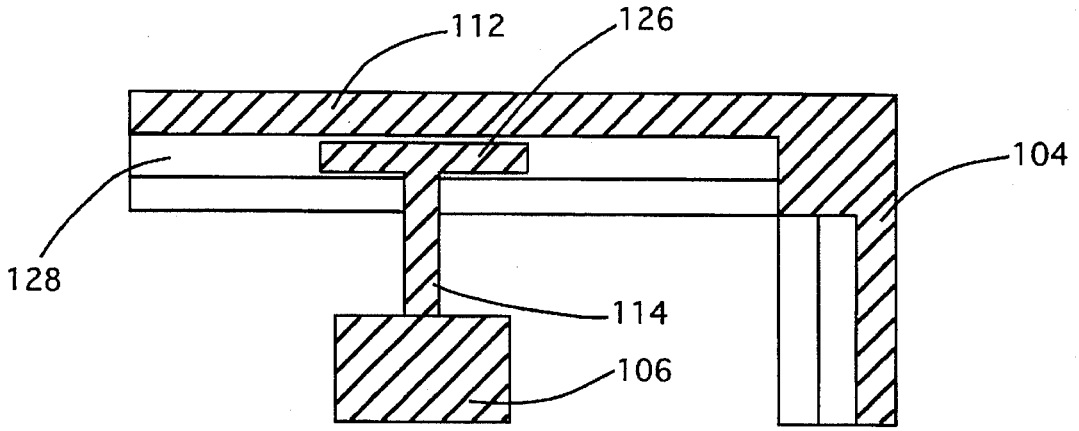
FIG. 6 is an enlarged sectional view along the line 6—6 of FIG. 5, showing the sectional view of the structure supporting a thrust rod of an actuator.

An understanding of the operation of thrust rod 114 of vertical actuator 106, and horizontal arm 112 of the sweeper 84 will become apparent by referring to the detailed drawing of FIG. 5 and FIG. 6 where thrust rod 114 of vertical actuator 106, made of rigid material, has a flange 126 at its upper end adapted to sliding movement along a guideway 128 in horizontal arm 112 of the upright member 104 of sweeper 84. Guideway 128 in horizontal arm 112 is adapted to enclose and engage flange 126 of the vertical actuator 106.

Referring now to FIG. 6, a view along view line 6—6 in FIG. 5, flange 126 of thrust rod 114, actuated by vertical actuator 106 is configured to have an extended length for supporting the weight of sweeper 84 during the translational movement in the guideway 128 of the horizontal arm 112 of the sweeper 84.

Figure 7:
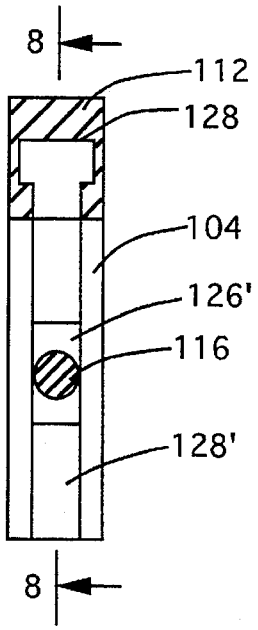
FIG. 7 is an enlarged sectional view taken along the line 7—7 of FIG. 3, showing the sectional view of a thrust rod in a guideway.
Figure 8:
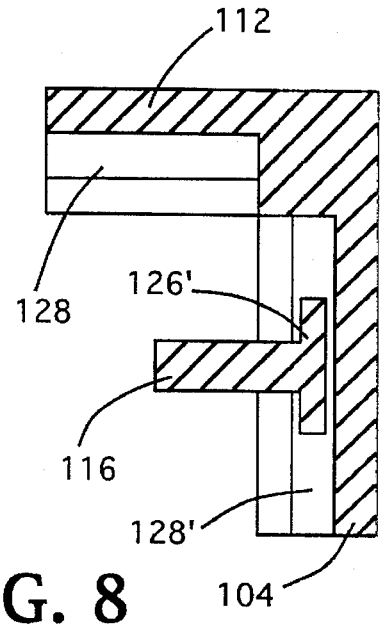
FIG. 8 is an sectional view along the line 8—8 of FIG. 7, showing the side sectional view of a thrust rod in a guideway.

An understanding of the operation of thrust rod 116 of horizontal actuator 108 and upright member 104 of the sweeper 84 will become apparent by referring to the detailed drawing of FIG. 7 and FIG. 8 wherein FIG. 7 is a view along view line 7—7 in FIG. 3. Thrust rod 116 of horizontal actuator 108, made of rigid material, has a flange 126' at its end adapted to sliding movement along a guideway 128' in the upright member 104 of sweeper 84. Guideway 128' in the upright member 104 is similarly adapted to enclose and engage flange 126' of the horizontal actuator 108.

Referring now to FIG. 8, a view along view line 8—8 in FIG. 7, flange 126' of thrust rod 116, actuated by horizontal actuator 108 is configured to have an extended length for steady movement of sweeper 84 during the translational movement in the guideway 128' of the upright member 104 of the sweeper 84.

Figure 9:
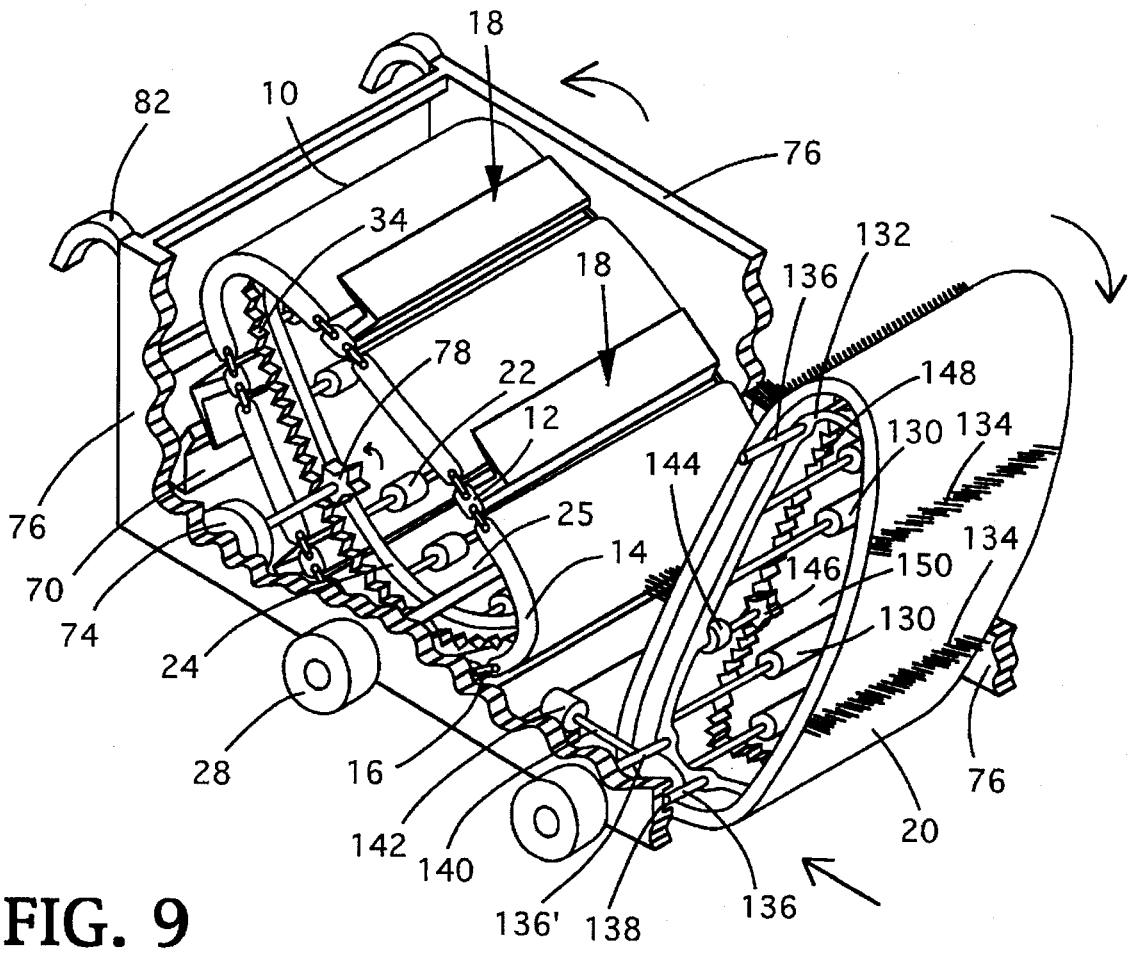
FIG. 9 is a simplified diagram of an embodiment of the invention employing two belts.

Referring now to FIG. 9, an embodiment of my invention employing two belts wherein like symbols of FIG. 2 and FIG. 9 refer to like elements, continuous deformable belt 10, made up of a plurality of articulating planar belt elements 12 linked for articulation with adjacent deformable sections 14 by linkage members 16 supports a plurality of spade-shaped collector elements 18, constrained to move in a closed vertical circuit defined by a first array of transverse extending rollers 22 in a counter-clockwise sense as shown by the counter-clockwise directional arrow, cooperates with a second continuous deformable belt 20, similarly constrained to move in a second closed vertical circuit defined by a second array of transverse rollers 130 supported by a bracket 132 in a clockwise sense as shown by the clockwise directional arrow, said second belt having an array of transverse spaced-apart rows of brushes 134 constituting a sweeping means. The circuits of belt 10 and belt 20 are configured so that a portion of each of the circuits nearest to the ground surface is substantially parallel to the ground surface being cleaned. An array of shafts 136 journaled in bracket 132 is adapted to sliding movement in a plurality of horizontal guideways 138 embedded in the walls of the body frame means 76. Thrust rod 140 of a frame-supported horizontal actuator 142, attached orthogonally to a shaft 136' which slides freely in a guideway 138, hidden from view in this figure, causes translational reciprocating movement of belt 20 with respect to belt 10. A power drive means 144, mounted on bracket 132, drives a cog-wheel 146 in rotational engagement with gear track 148 mounted on the inner surface 150 of belt 20, causing belt 20 to rotate in a clockwise direction as shown by the clockwise directional arrow. When the belt 10 rotates to a position where one of the spade-shaped collector elements 18 is ready for picking up sand, litter and the like, thrust rod 140 of horizontal actuator 142 causes the bracket 132 and rollers 130 defining the circuit of belt 20 to move towards belt 10 as indicated by the directional arrow. At the same time, a one of rows of brushes 134 mounted on belt 20 sweeps sand and debris onto the spade-shaped collector element 18. After the brushes 134 has swept debris into the spade-shaped collector element 18, thrust rod 140 of the horizontal actuator 142 is extended to move the bracket 132 supporting the rollers 130 away from belt 10 so that the spade-shaped collector element 18 has enough space to translocate upwards and away from the ground, without striking at the outer surface of belt 20. The rotations of belt 10 and belt 20 are synchronized and the locations of spade-shaped collector element 18 and the rows of brushes 134 are preselected to permit unobstructed synchronized rotation of both belts.

Belt 10 is rotational in a counter-clockwise sense about a first horizontal axis, while belt 20 is rotational in a clockwise sense about a second horizontal axis, as shown by the directions of the arrows. When both belts are so rotated with their horizontal rotational axes substantially parallel, a one of the spade-shaped collector element 18 is moving substantially parallel to ground surface being cleaned. Simultaneously, a one of the rows of brushes 134 is rotational with a sweeping action to sweep sand and debris into the spade-shaped collector element 18. Sand and debris is then transported by the spade-shaped collector element 18 for free fall into storage container 70.

To ensure efficient collection of sand and litter from the ground, a stored program device means of FIG. 3, not shown, is used to activate and control the power drive means, 74, horizontal actuator 142 and power drive means 144. The discussion about the distance to be covered by the sweeper 84 of FIG. 3 in each successive debris collection in the embodiment of FIG. 3 is also applicable to the distance transversed by belt 20 in translational reciprocating movement with belt 10 moving across the ground surfaces.

A control handle means (not shown) with appropriate mechanical drive means for selective elevation, as is well known in the art, can be used to adjust the vertical position of the belts relative to the ground, so that the belts can be selectively positioned as desired to accommodate different terrain conditions.

Rollers 22 defining the circuit of belt 10 are supported by brackets 24 from a body frame, not shown, as are support means 60, support means 62, upright support means 46, wheels 28 and debris receiver 70 and the like. It should be understood that those elements of the cleaning device illustrated in FIG. 1 and FIG. 3 are conventionally mounted on a supporting frame (not shown) permitting manual directional control and movement of the debris-clearing device in cleaning relationship with roadways and the like. A protective shield (not shown) may be employed as required to assure that the brushes and other rotating mechanical elements will not present a safety hazard.

It would be obvious to those skilled in the art to substitute structural element equivalent to the articulating planar belt elements of FIG. 1, as by mounting an array of spaced-apart rigid plates on the belt to selectively enhance the stiffness of the belt in supporting the spade-shaped collector element. It is understood that the conveyor belts as employed in the invention can be constructed and rotated similarly to the belted drives of tractors and other off-road vehicles. It would be obvious to mount a flexible lip of a deformable rubber-like material along the leading edge of each of the spade-shaped collector elements to prevent gouging of the surface being cleaned of debris. Similarly, it is obvious to have an array of short spikes mounted along the leading edge of one or more of the spade-shaped collector elements.

It is also obvious to mount suitable laminates of thin, flexible and deformable strips of material on the sole plate surfaces of the spade-shaped collector elements. Laminates, made of densely populated resilient strips of material, can also be mounted and extended outwardly from the leading edge of the spade-shaped blade of the collector elements. This would provide better coverage on the ground surface and reduces wear upon the spade-shaped collector element moving in contact with uneven ground surfaces. It is clear that a thin sheet of enclosure may be mounted at a distance above the spade-shaped collector element for confinement of sand and debris during debris transportation.

The drive wheel 39 and drive wheel 40 of FIG. 1 are the simplest elements used to illustrate how the various elements in the device would function. They may be replaced by mechanical gears of appropriate sizes. A chain may be used other than the belt employed in the transmission to provide better tension and motions of various elements in the collecting device. The figures shown in the drawings are the simplified pictures to illustrate how the various elements would function in a collecting device. For stability of the rollers and some other rotating components, it is clear that additional structures and frame means may be added to support the rollers and other rotating components. For example, the drive wheel 39 and drive wheel 40 of FIG. 1 may be supported by additional frame means attached to the body frame of the collecting device.

It is obvious that the spade-shaped collector dement and the brushes shown in FIG. 1 which serve respectively as a cooperative collector means and a sweeping means, can be replaced by a variety of other materials, such as brooms, sponges and the like, or a combination of suitable cleaning materials for clearing debris off the surface being cleaned. For example, without departing from the invention, a strip of material can be added behind each row of brushes in the embodiment of FIG. 9 to catch and transport solid particulate wastes, sand and the like, which filter through the bustles of the brushes. The path provided by the guides illustrated in FIG. 1 is one of many possible circuits for the movement of the sweeper element in executing a process repeatedly in sweeping debris into the spade-shaped collector element. Circuit of different shapes may be provided by the guide for the sweeper in the repetitive process of sweeping debris along the ground surfaces. To reduce frictions brought on by the rotational and linear motions of various elements of the apparatus, bearings of appropriate sizes may be employed to reduce wear and ensure smooth motions and functions of the various elements in the apparatus. It is also clear that a debris receiver can have other shapes or structures, instead of the rectangular one as shown in FIG. 1, FIG. 2 and FIG. 9. A sweeper element can also be substituted by a roller mounting rows of brushes.

It is obvious that a sensor can be used to detect the presence of a particular type of debris, such as bottles or the like, on the ground surface, so that a stored program device means may activate the actuators and the power drive means in the debris cleaner device for the collection of the debris.

Having described the invention and its preferred mode of operation in sufficient detail for those of normal skill in the art to practice the same, it will be obvious to such practitioners to make certain changes and variations in the specific elements of the disclosed embodiments without departing from the scope of the invention. For these reasons, the scope of the invention should not be limited by that which has been illustrated herein but should be limited only by the scope of the appended claims:

I claim:

1. A device for removing sand and debris from roadways, in combination with a wheeled means defining a frame, comprising:

a) belt means defining a continuous belt, mounting a plurality of collector means comprising an array of spade-shaped collector elements adapted to elevate and transport said sand and debris, moving in a pre-defined vertical circuit, a portion of said vertical circuit being substantially parallel to the surface of the said roadways, and having a horizontal axis of rotation;

b) sweeper element means translocating along a pre-defined path with a predetermined velocity in a reciprocating sweeping motion relative to the said spade-shaped collector elements for sweeping said sand and debris towards said spade-shaped collector elements;

c) a plurality of power drive means for imparting controlled motion to said spade-shaped collector elements and said sweeper element means;

d) transmission means to synchronize movement of said sweeper element means with a one of said spade-shaped collector elements during each cycle of sweeping operation; and, e) receiver means for catching and retaining said sand and debris gravitating from each of said spade-shaped collector elements at an elevated locus of said vertical circuit.

2. The device of claim 1, wherein said device includes a stored program device means for selectively activating and controlling each said power drive means.

3. The device of claim 2, wherein said device includes a plurality of sensors for use with said stored program device means.

4. A wheeled frame mounted device for continuously cleaning debris from roadways, comprising:

a) first means defining a first continuous belt moving in a first pre-defined vertical circuit, a lower portion of said first circuit being substantially parallel to the surface of the said roadways, and having a first horizontal axis of rotation, said first belt mounting a plurality of collector means comprising an array of spade-shaped collector elements for elevating and transporting said debris, whereby when each of said spade shaped collector elements reaches said lower portion of said first circuit, a portion of the respective spade shaped collector element is positioned substantially adjacent and parallel to said roadway;

b) first power drive means for rotationally driving said first belt; and, c) receiver means for receiving said debris from said spade-shaped collector elements.

5. The device of claim 4, wherein said device includes a second means defining a second continuous belt translocating along a pre-defined second vertical circuit having a second horizontal axis of rotation parallel to said first horizontal axis of rotation, said second belt including means for moving said debris along said roadways towards said spade-shaped collector elements.

6. The device of claim 5, wherein said device includes a second power drive means for rotationally driving said second belt.

7. The device of claim 5, wherein said means for moving said debris comprises rows of brushes.

8. The device of claim 6, wherein said device includes a stored program device means for selectively activating and controlling said first power drive means and said second power drive means.

9. The device of claim 8, wherein said device includes a plurality of sensors for use with said stored program device means.

10. A frame mounted device for continuously clearing debris during transport in debris-clearing relationship with roadways, comprising:

a) belt means defining a continuous belt moving in a pre-defined vertical circuit having a horizontal axis of rotation, said belt means mounting a plurality of collector means comprising an array of spade-shaped collector elements to elevate and transport of said debris;

b) sweeper means for sweeping said debris along roadways towards said spade-shaped collector elements;

c) a plurality of power drive means for imparting controlled motion to said sweeper means and said spade-shaped collector elements;

d) a stored program device means for selectively activating and controlling each said power drive means;

e) means for sensing the proximity of said spade-shaped collector elements and the said sweeper means; and, f) receiver means for receiving said debris after elevation by said spade-shaped collector elements.

* * * * *